US008052178B2

(12) United States Patent
MacDonald et al.

(10) Patent No.: US 8,052,178 B2
(45) Date of Patent: Nov. 8, 2011

(54) TEMPORARY DOOR LOCK ASSEMBLY

(75) Inventors: Hugh MacDonald, Dover, FL (US); Carl Christopher Sutherland, Plant City, FL (US)

(73) Assignee: Templok, Inc., Dover, FL (US)

( * ) Notice: Subject to any disclaimer, the term of this patent is extended or adjusted under 35 U.S.C. 154(b) by 451 days.

(21) Appl. No.: 11/778,836

(22) Filed: Jul. 17, 2007

(65) Prior Publication Data

US 2008/0023969 A1 Jan. 31, 2008

Related U.S. Application Data

(60) Provisional application No. 60/833,082, filed on Jul. 25, 2006.

(51) Int. Cl.
*E05C 1/04* (2006.01)

(52) U.S. Cl. ..... 292/145; 292/DIG. 64; 292/353; 292/348

(58) Field of Classification Search ..... 292/145, 292/348, 353, 357, DIG. 2, DIG. 38, DIG. 41, 292/DIG. 44, 138, 137, DIG. 54, DIG. 64
See application file for complete search history.

(56) References Cited

U.S. PATENT DOCUMENTS

| | | | | |
|---|---|---|---|---|
| 4,109,948 | A | 8/1978 | Potter | |
| 4,169,618 | A | 10/1979 | Potter | |
| 5,192,097 | A * | 3/1993 | Su | 292/166 |
| 5,249,444 | A * | 10/1993 | Dancs | 70/380 |
| 5,265,924 | A * | 11/1993 | Kim | 292/336.3 |
| 6,502,436 | B2 * | 1/2003 | Beatty | 70/134 |
| 6,874,827 | B1 | 4/2005 | Dodson | |

* cited by examiner

*Primary Examiner* — Carlos Lugo
*Assistant Examiner* — Mark Williams
(74) *Attorney, Agent, or Firm* — Michael J. Colitz, III; GrayRobinson, P.A.

(57) ABSTRACT

Disclosed is a temporary door lock assembly. The assembly is formed from five major components: a rosette; a bolt; a barrel; a locking arm; and an inside plate. These components are lockingly interconnected without any fasteners or the use of any tools to form a door lock. The lock can be temporarily secured within the lock opening and barrel of a door frame during residential or commercial construction to thereby delay the need to install more complicated and expensive permanent locks.

1 Claim, 8 Drawing Sheets

FIG. 2
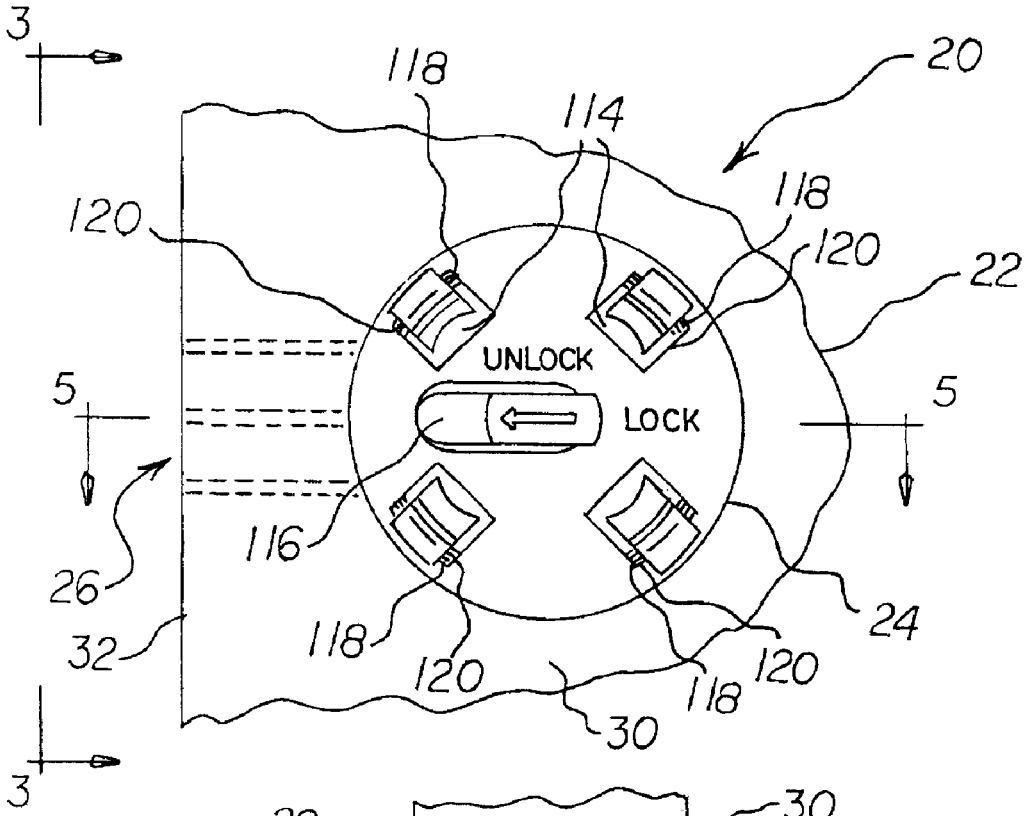
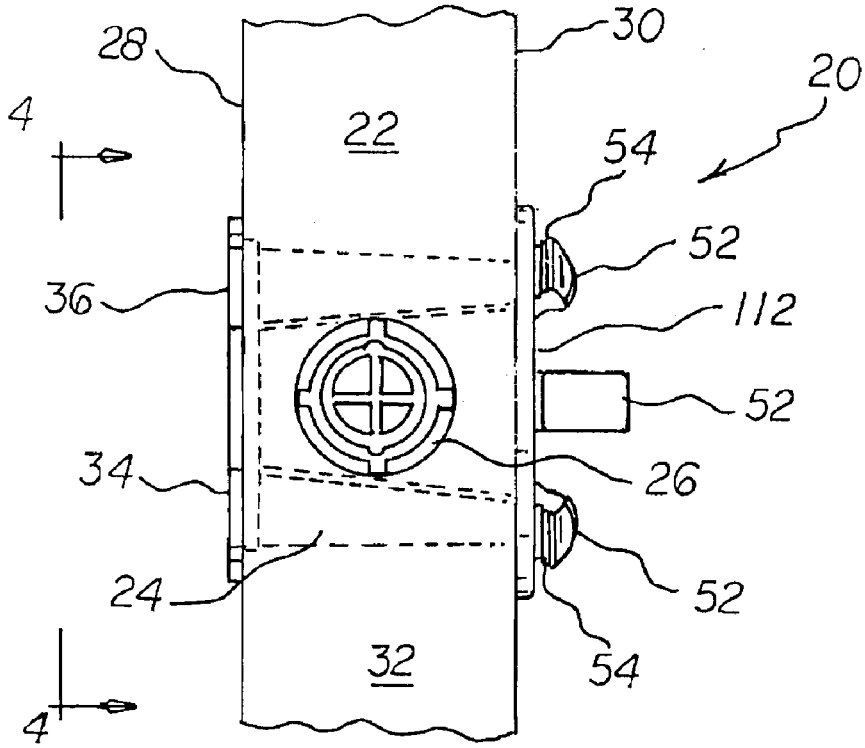
FIG. 3

FIG. 4
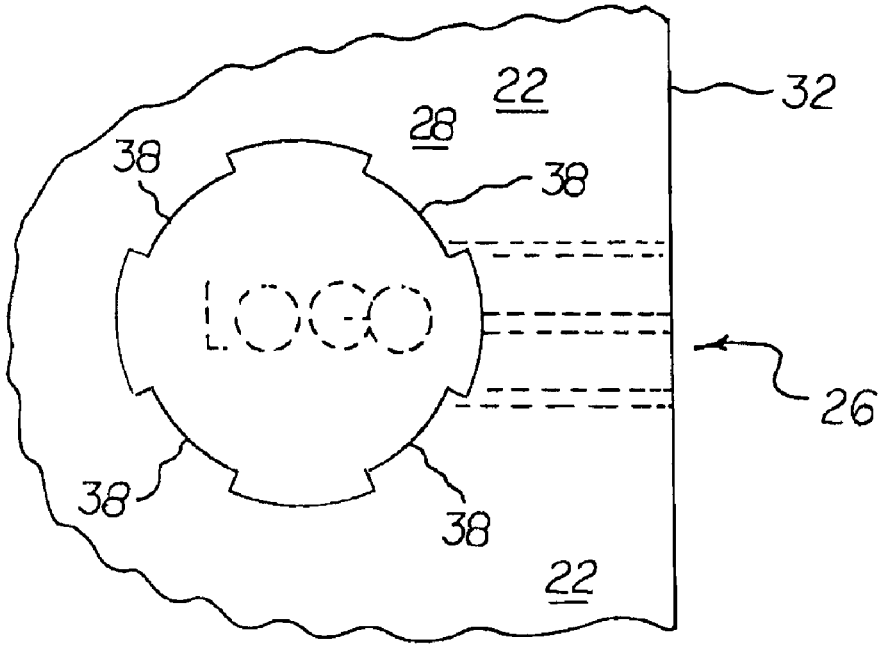
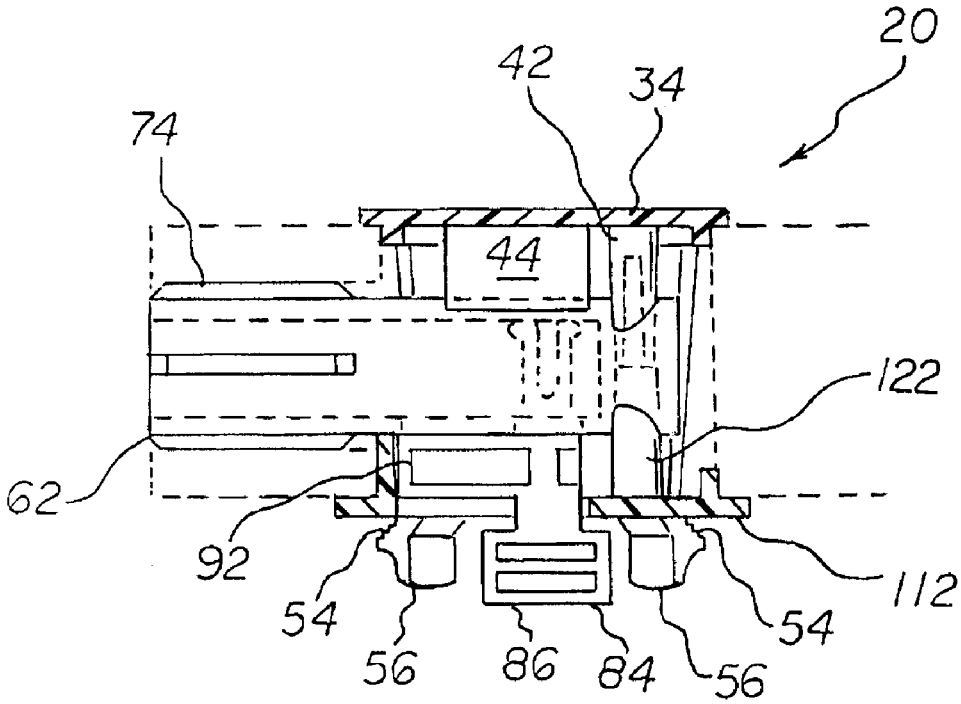
FIG. 5

FIG. 6
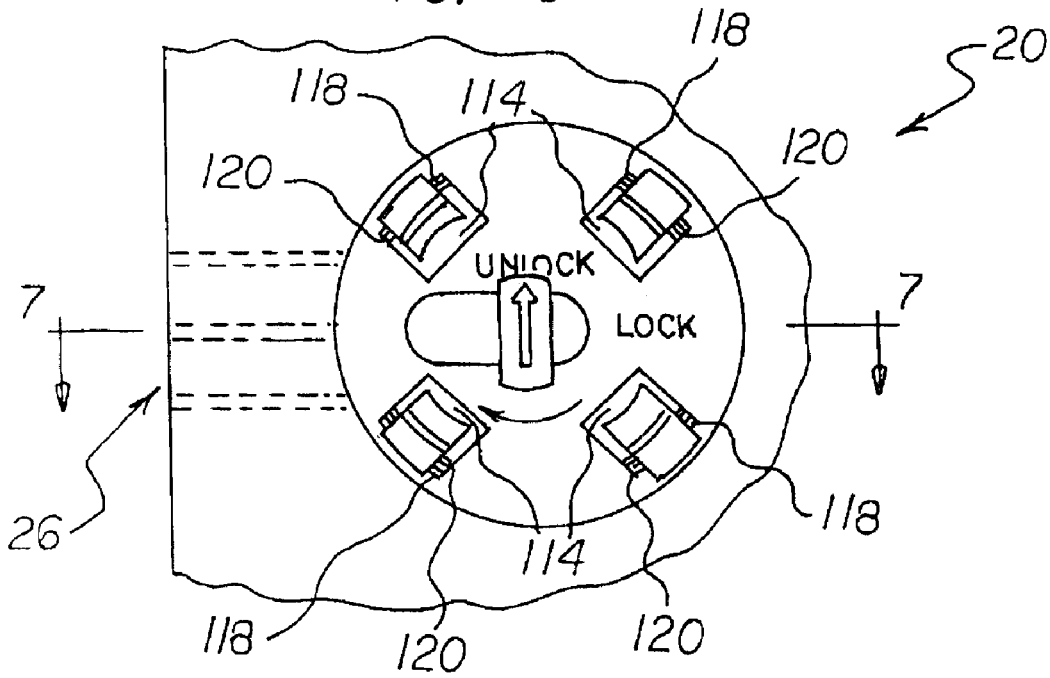
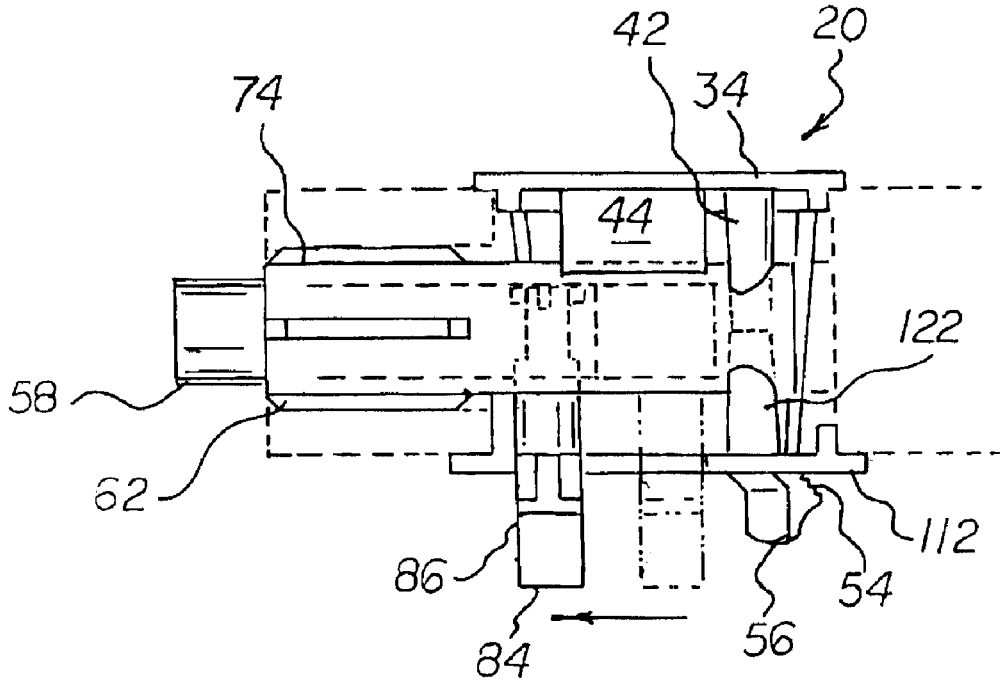
FIG. 7

FIG. 12
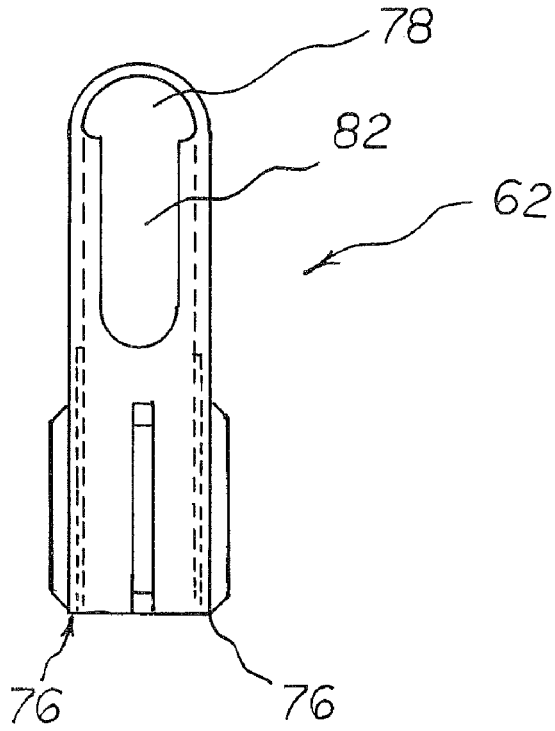
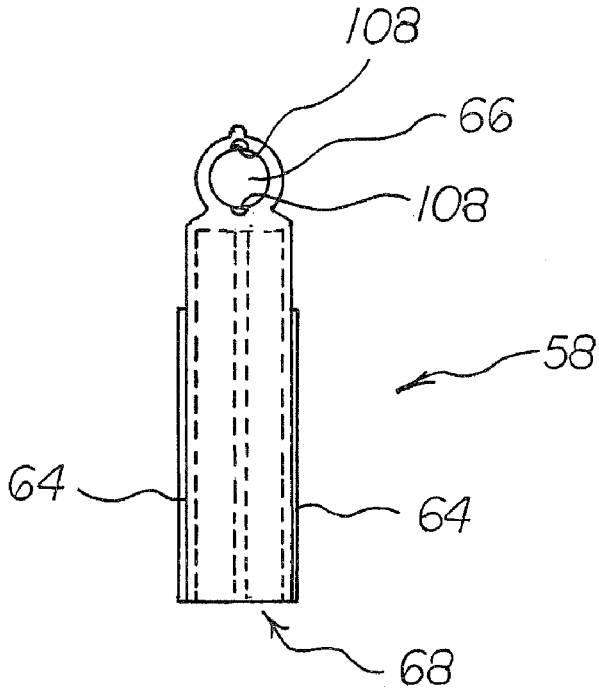
FIG. 13

TEMPORARY DOOR LOCK ASSEMBLY

RELATED APPLICATION DATA

This is a continuation of provisional application Ser. No. 60/833,082 filed on Jul. 25, 2006 and entitled "Temporary Door Lock." The contents of this application are fully incorporated herein.

BACKGROUND OF THE INVENTION

1. Field of the Invention

This invention relates to a temporary door lock assembly and more particularly relates to a temporary door lock assembly that can be used in place of a permanent lock during building construction to deter causal entry into the building.

2. Description of the Background Art

There is a need in the construction industry for a durable, yet disposable, temporary lock that can be used to secure a door during commercial or residential construction. Early during the construction process, doors are hung on door frames, both within the interior and around the exterior of the structure being built. These doors typically arrive on the construction site with a lock opening and a lateral bore that are designed to be fitted with a conventional lockset.

Although doors are often installed early in construction, permanent locksets are typically one of the last items to be installed. This occurs because it would be logistically problematic to provide keys to everyone on the job site, and because the expense of providing standard locksets is considerable. Permanent lockset are also susceptible to damage during construction. Thus, doors on a construction site are often left completely unsecured. This is obviously not a preferred solution for a variety of reasons. First, although unoccupied, buildings under construction still house valuable tools, equipment and building materials. Leaving the doors unsecured results in these valuables being stolen or damaged. Second, leaving the building unsecured unnecessarily invites individuals to vandalize or otherwise damage the on-going construction during the non-working hours. Third, unsecured doors are susceptible to being blown open, thereby leaving the interior of the building exposed to the elements. This is especially problematic during the later stages of construction or at a point where drywall or other moisture absorbing materials may have been installed. Finally, wind can also cause unsecured doors—whether installed or yet to be installed—to be repeatedly blown open and closed, thereby damaging the door and surrounding frame.

For the foregoing reasons, there exists a need in the construction industry for a temporary door lock that can be quickly and easily installed within a door prior to the installation of a permanent lockset.

The use of temporary latches that are installed indoors until a permanent latch can be installed are known. For example, U.S. Pat. No. 6,874,827 to Dodson discloses a temporary door latch. The latch is adapted to be secured within the opening provided in a door. This latch generally consists of two pieces: a handled portion and a tongue portion. The latch is installed into the door opening by first disengaging the tongue portion from the handle portion. The handle portion is then inserted into a larger bore within the door opening. Thereafter, the rear end of the tongue portion is inserted into the smaller bore of the lock opening via the edge of the door. The handle portion is further provided with a ring for grasping and a compressible arm that retracts to cause the tongue portion to be withdrawn into the door latch opening as the door is being closed and when the door is being unlocked from its door frame.

The use of plastic door locks is also known. For example, U.S. Pat. No. 5,192,097 to Su discloses a plastic door lock that includes opposing cover plates between which is located a latch unit and a limit switch. The limit switch can be moved between an unlocked position wherein actuation of the latch unit is permitted and a locked position wherein actuation of the latch is precluded from outside of the door. All of the components of this lock are molded from a plastics type material.

Additionally, U.S. Pat. No. 4,169,618 to Potter discloses another plastic door lock construction. The lock includes opposite roses that are adapted to interlock with each other and which are held together by a single screw. When used as a privacy lock, unlocking the lock from the outside is prevented by pushing the inside knob into a releasable but non-rotatable engagement with the inside rose. The lock, as well as the individual parts comprising the lock, are made up of a moldable plastic material.

Finally, U.S. Pat. No. 4,109,948 to Potter discloses a plastic latch bolt for a door lock. The lock includes a lost motion connection between the latch bolt and spindle that allows the door to be closed without damaging the latch bolt when the inside knob is locked. Again, the lock makes use of various plastic materials for most of the individual parts.

Thus, the use of plastic door locks and temporary latching devices for use within doorways is known. However, although the above referenced inventions each achieve their own individual objectives, they all suffer from common drawbacks. Namely, none of the background art discloses a temporary door lock that has a simple and inexpensive construction and which requires no tools for assembly and installation. Further, none of the background art discloses a lock whereby the inner and outer faces are joined with a ratchet type interconnection whereby the assembly can be installed on doors having a variety of thicknesses.

SUMMARY OF THE INVENTION

It is therefore one of the objectives of this invention to provide a temporary door lock that employs a simple construction and which can be used to temporarily replace expensive final locks.

It is also an objective of this invention to create a durable but lightweight temporary door lock that is inexpensive and disposable.

It is yet another objective of the present invention to provide a temporary door lock that is made from a plastic material thereby allowing the complete assembly to be injection molded.

It is still yet another objective of this invention to create a temporary door lock assembly wherein all the subcomponents can be assembled and installed without the use of tools or fasteners.

Another object of the present invention is to create a temporary door lock that can be use upon a door as a shipping clip during the transport of the door from the factory to the construction site.

It is another object of the present invention to create a lock assembly which is self adjusting to accommodate varying door thicknesses.

It is still yet another object of this invention to provide a temporary door lock that can be painted over such that the resulting paint line on the door will fall within the dimensions of a final finished lockset escutcheon to thereby eliminate the need to mask the permanent lock during subsequent painting.

Still yet another object of the present invention is to create a temporary lock assembly that closely resembles the normal action of a deadbolt lockset in form and function.

BRIEF DESCRIPTION OF THE DRAWINGS

For a more complete understanding of the nature and objects of the invention, reference should be made to the following detailed description taken in connection with the accompanying drawings in which:

FIG. 2 is an elevational view of the inside plate of the lock assembly as installed in a door.

FIG. 3 is a side elevational view taken along line 3-3 of FIG. 2.

FIG. 4 is a view of the rosette as installed on the exterior face of a door and as taken from line 4-4 of FIG. 3.

FIG. 5 is a partial cross sectional view taken along line 5-5 of FIG. 2.

FIG. 6 is a view of the inside plate upon the interior surface of the door and showing the locking arm being moved from the locked to the unlocked position.

FIG. 7 is a partial sectional view taken along line 7-7 of FIG. 6.

FIG. 12 is a detailed view of the barrel of the present invention as taken along line 12-12 of FIG. 11.

FIG. 13 is detailed view of the bolt of the present invention as taken along line 13-13 of FIG. 11.

Similar reference characters refer to similar parts throughout the several views of the drawings.

DETAILED DESCRIPTION OF THE PREFERRED EMBODIMENT

Figure 1:
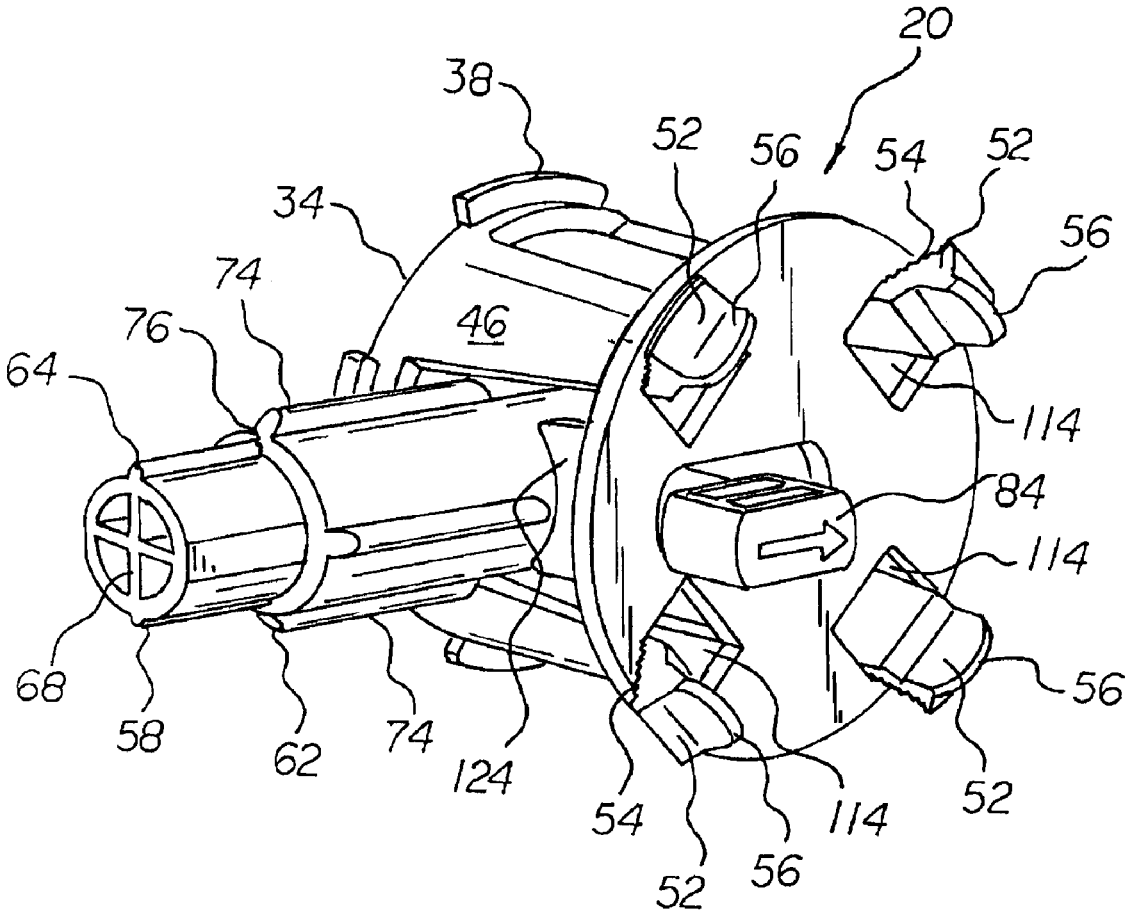
FIG. 1 is a perspective view of the temporary door lock in accordance with the present invention.

With reference to FIG. 1, the assembled view of the temporary door lock is illustrated. The assembly is formed from five major components: a rosette; a bolt; a barrel; a locking arm; and an inside plate. These components are lockingly interconnected without any fasteners or the use of any tools to form a door lock. The lock can be temporarily secured within the lock opening and barrel of a door frame during residential or commercial construction to thereby delay the need to install more complicated and expensive permanent locks. The temporary lock is installed by positioning the bolt and barrel within the hole bored in the edge of the door. The rosette and inside plate are then placed over the exterior and interior sides of the lock opening respectively, such that the barrel is secured to an upstanding boss on the rosette and a post on the inside plate. The locking arm can then be used to extend or retract the bolt from the barrel to thereby lock and unlock the door. In this manner, the assembly deters the unauthorized intrusion into the building under construction. The various components of the present invention, and the manner in which they interrelate, are described in greater detail hereinafter in connection with FIGS. 1-15.

The Door Frame and Prep Hole

Typically, early on in the construction process, doors 22 are hung from door frames, on both internal door frames and external door frames. These doors 22 usually include pre-formed prep holes to allow for the installation of permanent locksets. These prep holes include a lock opening 24 for the lockset and a laterally disposed barrel opening 26 for the latch. The temporary door lock assembly 20 of the present invention assembly is dimensioned to be received within the lock opening 24 and barrel 26 of a conventional door frame. Thus, temporary lock 20 is designed to take the place of a permanent door lock during the construction process. Temporary door lock 20 of the present invention can be used in connection with a wide variety of door constructions 22, such as wooden, glass, fiberglass or metal doors. As noted in FIGS. 2 and 3, door 22 is generally defined by both exterior and interior sides (28 and 30, respectively) and a longitudinal side edge 32. Lock opening 24 extends through both the exterior and interior sides (28 and 30) of door 22. Barrel opening 26 extends through the longitudinal edge 32 and is interconnected to lock opening 24. Both the lock opening and barrel opening (24 and 26) have a diameter that is dimensioned to receive a standard lockset—typically, 2⅜" for the lock opening and 1" for the barrel opening. However, assembly 20 can be made in any of a variety of sizes to accommodate varying lock and barrel openings.

The various components of the temporary door lock 20 are individually described hereinafter. It should be noted that all of the components are preferably injection molded from a high strength impact resistant Nylon, Polycarbonate and/or ABS plastic. Although the use of other materials and manufacturing techniques are within the scope of the present invention, the preferred embodiment employs an injection molded Nylon. In this regard, several of the components can include recesses, called coring in the plastics industry, such as the locking arm illustrated in FIG. 11, to facilitate the cooling of the pieces after molding. Other design features, such as drafting, tapering, and coring, can be included to facilitate the removal of the pieces from the associated mold cavity.

The Rosette

As noted in FIG. 1, rosette 34 is one of the components of the temporary door lock assembly 20. Rosette 34 includes a base plate 36 with interior and exterior sides (corresponding to the interior and exterior sides of the door). The exterior side of base plate 36 has a diameter that is slightly larger than the prep hole within door 22. Base plate 36 is thus sized to fit over the exterior side of the prep hole. In order to deter unauthorized entry when lock 20 is installed, temporary lock assembly 20 cannot be operated from the exterior side 28 of door 22. As such, the exterior side of base plate 36 contains no openings. However, as noted in FIG. 4, the exterior side of base plate 36 can include a logo or other indicia.

Figure 8:
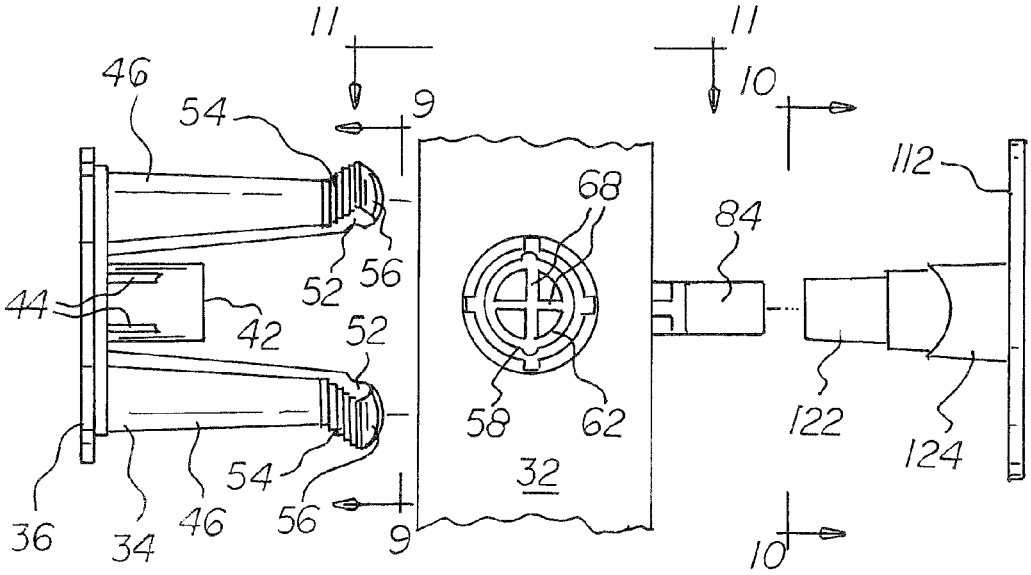
FIG. 8 is an exploded view of the lock assembly of the present invention.
Figure 9:
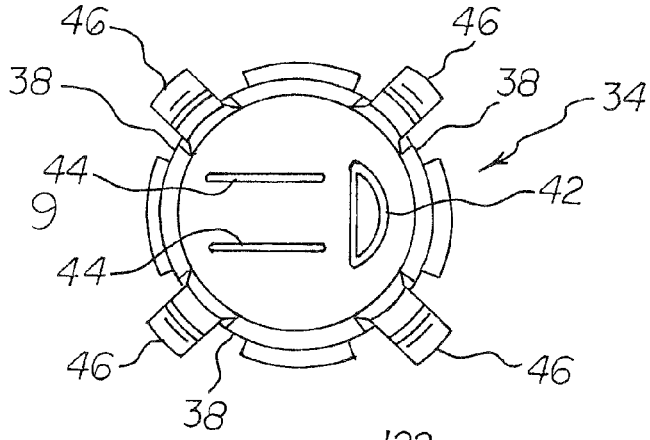
FIG. 9 is a plan view of the rosette as taken along line 9-9 of FIG. 8.

With continuing reference to FIG. 4, it will be seen that a series of notches 38 are formed about the peripheral edge of base plate 36. Still yet additional features of the base plate are illustrated in FIGS. 8 and 9. Namely, a female semicircular boss 42, a pair of rails 44, and four biased locking arms 46 are integrally formed upon the interior side of base plate 36. Each of the arms 46 has an inward taper along its length from the proximal end adjacent base plate 36 to a distal end. Thus, although base plate 36 is larger than the standard prep hole, the diameter formed by the locking arms 46 is appreciably less to thereby allow the arms to be inserted into the prep hole. The biased nature of arms 46 enables each to flex inwardly under pressure, which may be necessary to enable the arms to be fully inserted. This flexibility further aids in retaining rosette 34 within the hole in a manner described hereinafter. With specific reference to FIG. 8, it will be seen that the distal end of each arm 46 has an angled portion 52. In the preferred embodiment, each distal end is angled outwardly at approximately a 45 degree angle (as measured from the axis of the rosette). Furthermore, each angled portion 52 includes a series of teeth 54 that function in retaining arms 46 upon the inside plate. A small tab 56 (FIG. 1) is provided at the distal end of each arm 46 to aid in the flexing or otherwise manipulating the associated arm 46.

The Bolt and Barrel

The bolt and barrel (58 and 62) are next described in connection with FIGS. 11, 12, and 13. Both the bolt and barrel (58 and 62) are generally defined by proximal and distal ends and an intermediate extent. Bolt 58 further includes a pair of diametrically opposed strengthening ribs 64 that are integrally formed upon its outer surface. In the preferred embodiment, these ribs 64 begin at the distal end of the bolt and extend over more than half of the bolt's overall length. Nonetheless, the present invention is not limited to any particular number or configuration of ribs. Bolt 58 further includes an actuating hole 66 formed through its proximal end. Actuating hole 66 functions in rotatably accepting the locking arm in a manner more fully described hereinafter. As illustrated in the end view of FIG. 14, the interior of the bolt 58 is strengthened by two intersecting ribs 68. These strengthening ribs 68 make the bolt 58 strong enough to resist breakage while it is protruding and interfacing with the door jam. Bolt 58 is also preferably tapered along its length to allow the core of the mold to be easily retracted, thereby speeding molding operations and production.

Barrel 62 includes a hollow interior 72, which permits it to accept bolt 58. A series of four strengthening ribs 74 are integrally formed and evenly spaced upon the exterior surface of barrel 62. These ribs 74 begin at the distal end of barrel 62 and preferably have a length that is less than half of the barrel's overall length. Again, however, this is illustrative of only one possible rib geometry. The hollow interior 72 of barrel 62 is generally smooth, and includes a pair of diametrically opposed receiving grooves 76. As noted in FIG. 12, these grooves begin at the distal end of barrel 62 and have a length that generally matches the length of the bolt ribs 64. The bolt and barrel (58 and 62) are telescopically interconnected by sliding the ribs 64 of bolt 58 within the receiving grooves 76 of barrel 62. Due to the limited length of the ribs and grooves (64 and 76), the sliding movement of bolt 58 within barrel 62 is limited. Namely, in the fully retracted position, the proximal end of bolt 58 is spaced from the proximal end of the barrel 62.

With reference now to FIG. 12, the semi-circular notch 78 of barrel 62 is illustrated. This semi-circular notch 78 is preferably formed through the proximal end of barrel 62 and is used in securing the bolt and barrel (58 and 62) between the rosette 34 and inside plate in a manner described in greater detail hereinafter. Due to the limited sliding movement of bolt 58 within barrel 62, this notch 78 is accessible even when bolt 58 is fully retracted within barrel 62. With continuing reference to FIG. 12, slot 82 that is interconnected to semi-circular notch 78 is depicted. Slot 82 extends along a length of the intermediate extent of barrel 62. Preferably, the distal end of slot 82 terminates adjacent the proximal end of receiving grooves 76. With bolt 58 telescopically received within barrel 62, slot 82 provides access to the actuating hole 66 of bolt 58. This, in turn, allows the locking arm to control the position of bolt 58 within barrel 62 as noted hereinafter. When lock 20 is fully assembled, and as noted in FIG. 14, the bolt and barrel (58 and 62) are positioned within the barrel opening 26 of door 22. Door 22 can thereafter be locked by extending bolt 58 to a position beyond longitudinal edge 32 of door 22. The bolt and barrel (58 and 62) are further secured to rosette 34 by positioning the female semi-circular boss 42 of rosette 34 within the semi-circular notch 78 of barrel 62. In this position, the intermediate extent of barrel 62 rests upon the pair of rails 44 on the interior surface of base plate 36.

The Locking Arm

Figure 11:
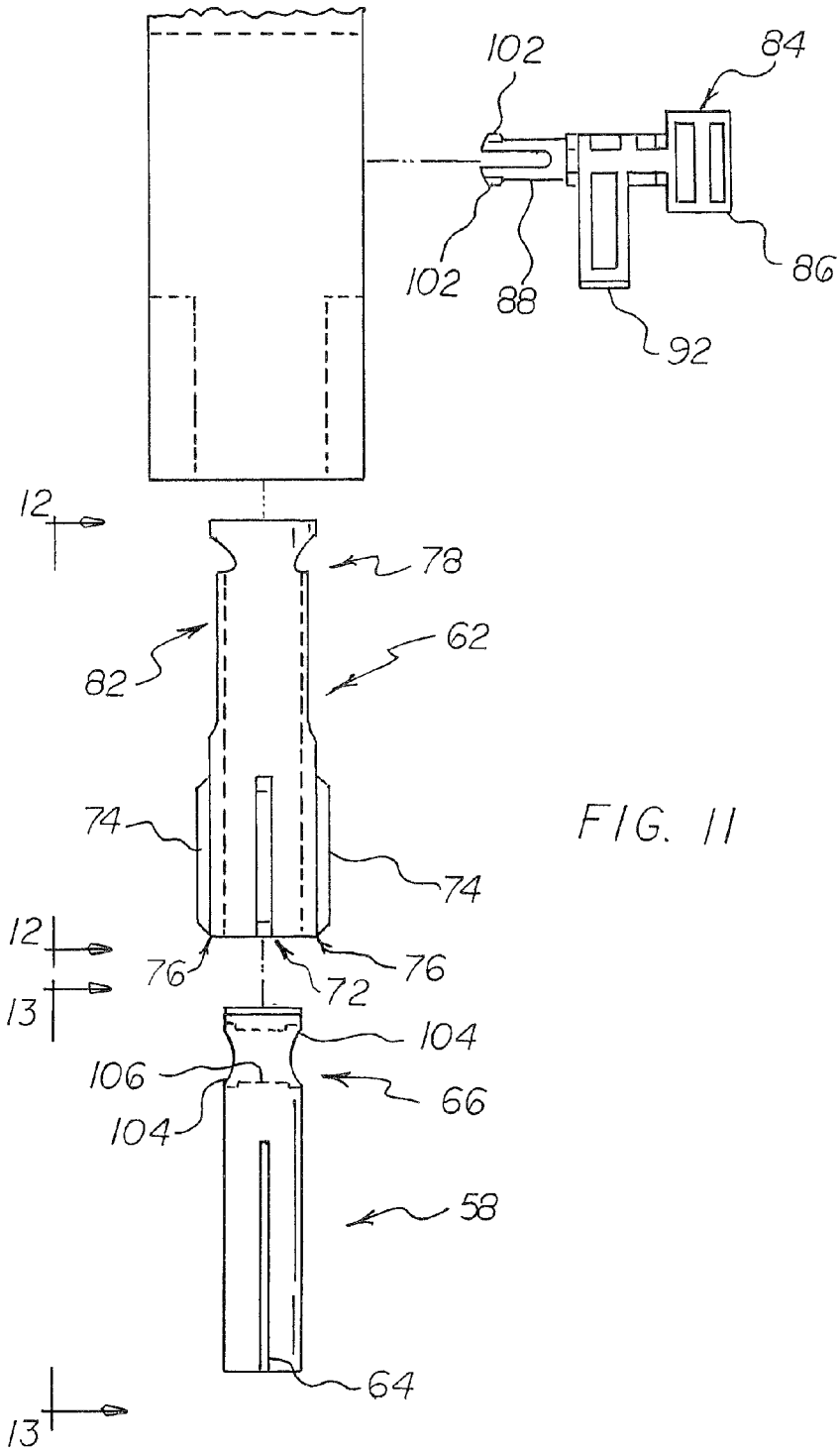
FIG. 11 is a exploded view of the bolt, barrel, and locking arm of the present invention.

With reference to FIG. 11, the locking arm 84 of the present invention is described. Locking arm 84 has three subcomponents: a turn knob 86 at a first end; a pair of resilient tabs 88 at a second end; and an intermediate detent 92. Turn knob 86 permits a user to operate the locking assembly by selectively extending or retracting bolt 58 from barrel 62. Resilient tabs 88 are used to rotatably interconnect locking arm 84 to the actuating hole 66 of the bolt 58 via a snap fit connection. Detent 92 is employed in selectively locking the assembly 20 in either the extended or retracted orientations.

In the preferred embodiment, each of the resilient tabs 88 includes a corresponding locking flange 102. Furthermore, as noted in phantom in FIG. 11, actuating hole 66 of bolt 58 is stepped on either side 104 thereby creating a narrowed intermediate portion 106. Thus, as flanges 102 engage the narrowed portion 106 of hole 66, the tabs 88 are flexed inwardly. Thereafter, a snap fit is achieved when flanges 88 reach the opposite end of hole 66.

Each stepped end 104 of actuating hole 66 further includes opposed recesses 108 that are dimensioned to receive flanges 102 upon the resilient tabs 88 (note FIG. 13). Flanges and recesses (102 and 108) cooperate to create two limiting catches as locking arm 84 is rotated within bolt 58. Namely, as the second end of locking arm 84 is rotated within hole 66, flanges 102 slightly bias tabs 88. This biasing force is generally less than the bias encountered by tabs 88 while in the intermediate portion 106 of hole 66. Thereafter, continued rotation brings locking arm 84 into one of the two positions where locking flanges 102 are received within opposed recesses 108. Preferably, this occurs at two angular positions that are separated by 180 degrees and at orientations that bring detent 92 into alignment with the longitudinal axis of barrel 62. When so positioned, tabs 88 take on an unbiased state. Thus, a larger degree of force is needed to overcome this unbiased state when rotating locking arm 84 out of one of these two angular orientations. In this manner, flanges and recesses (102 and 108) serve as limiting catches defining the two locked orientations of assembly 20. Thus, assembly 20 maintains a locked position due to flanges 102 snapping into recesses 108 inside of bolt 58.

The Inside Plate

Figure 10:
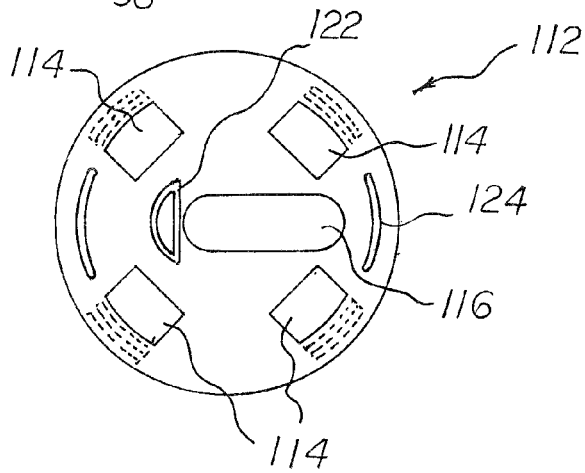
FIG. 10 is a plan view of the inside plate as taken along line 10-10 of FIG. 8.

The inside plate 112 is illustrated in FIG. 10. Plate 112 is generally defined by an interior side and an exterior side (which correspond to the interior and exterior sides of the door) and a peripheral edge. Inside plate 112 has a diameter that is slightly larger than lock opening 24. Plate 112 further includes a series of openings that allow it to be interconnected with rosette 34 and locking arm 84. These openings preferably include four radially located openings 114 and one diametrical slot 116. The four openings 114, which are depicted in FIG. 10, each include an edge 118 that is beveled into the interior surface of plate 112 adjacent the peripheral edge (note FIG. 6). Each beveled edge 118, in turn, includes a series of teeth 120. Inside plate 112 further includes a male post 122 and an arcuate wall 124 integrally formed upon the exterior side of plate 112. These features allow plate 112 to be interconnected to rosette 34 and barrel 62 in a manner described more fully hereinafter.

Inside plate 112 is installed by positioning it over the interior side of the lock opening 24 such that the four distal ends of locking arms 46 are positioned within the four radial openings 114. If necessary, tabs 56 at the end of each arm 46 can be used to bias the arms inwardly to facilitate insertion within openings 114. When properly inserted, teeth 54 on the distal ends of arms 46 lockingly engaging the teeth 120 of the beveled edges 118. The teeth 54 of the arms 46 and edges 120 create a ratcheting and adjustable interconnection. The outward force created by the biased arms 46 in conjunction with the mating teeth (54 and 120) causes the inside plate 112 to be pulled towards rosette 34. This, in turn, allows the assembly to be installed on doors 22 of varying thicknesses. The interconnection also prevents the unintended removal of inside plate 112. Inside plate 112 is further positioned such that male post 122 of plate 112 extends through the semi-circular notch 78 of barrel 62 and into the female semicircular boss 42 of rosette 34. Thus, male post 122 serves to lockingly interconnect barrel 62 to inside plate 112 and rosette 34. With the components so assembled, the arcuate wall 124 of plate 112 and rails 44 of rosette 34 supports the intermediate extent of barrel 62. Barrel 62 is thus connected between the inside plate 112 and rosette 34 and is firmly seated between arcuate wall 124 and rails 44.

Assembling the Temporary Lock

The assembly of the various components described above is as follows. First, bolt 58 is inserted into barrel 62 with ribs 64 of bolt 58 being inserted within the receiving grooves 76 of barrel 62. So assembled, the bolt and barrel (58 and 62) are telescopically interconnected. The bolt and barrel (58 and 62) combination is then inserted from the outside edge 32 of door 22 through the standard barrel hole 26 in door 22. Next, rosette 34 is inserted into the conventional door prep hole from the outside of door 22. Due to the size of rosette 34, the prep hole is completely covered so that no access is provided to the interior of the prep hole or the internal components of assembly 20. Rosette 34 is connected to barrel 62 by inserting the upstanding female boss 42 of rosette 34 into semi-circular hole 78 of barrel 62. This lockingly engages rosette 34 and barrel 62 but at the same time allows bolt 58 to freely slide within barrel 62.

The inside plate 112 is then installed by aligning its radial openings 114 with the corresponding upstanding arms 46 of rosette 34. Arms 46 can be flexed inwardly, if necessary, to ensure the distal ends of arms 46 are fully inserted within openings 114. Inside plate 112 is then further secured by pushing it down upon the arms 46 until the teeth 120 of plate 112 engage teeth 54 of arms 46. These teeth (120 and 54) cooperate to form a ratchet, whereby, depending upon the thickness of door 22, arms 46 ratchet along teeth 120 on the inside plate 112 as necessary to achieve a tight fit between 34 rosette on the outside 28 of door 22 and the outer periphery of inside plate 112 on the inside 30 of door 22. Thus, assembly 20 is self adjusting to varying door thicknesses due to the ratcheting spring action of the interlocking arms which connect inside plate 112 to rosette 34. The ratcheting arms 46 of rosette 34 also hook into the steps of the inside plate 112 in such a manner to make it very difficult to remove the lock from the outside of the door when the door is closed and locked.

Locking arm 84 is then inserted through diametrical slot 116 of inside plate 112. This is achieved by aligning detent 92 of locking arm 84 with slot 82 of barrel 62. Tabs 88 of locking arm 84 are similarly aligned with actuating hole 66 of barrel 62. Thereafter, resilient tabs 88 are inserted through slot 82 of barrel 62 and into actuating hole 66 of bolt 58. The stepped geometry of actuating hole 66 and the biased nature of tabs 88 serve to create a snap type fit. With the locking arm 84 so positioned, it is rotatably interconnected to bolt 58 and slidably connected to the barrel 62.

Figure 14:
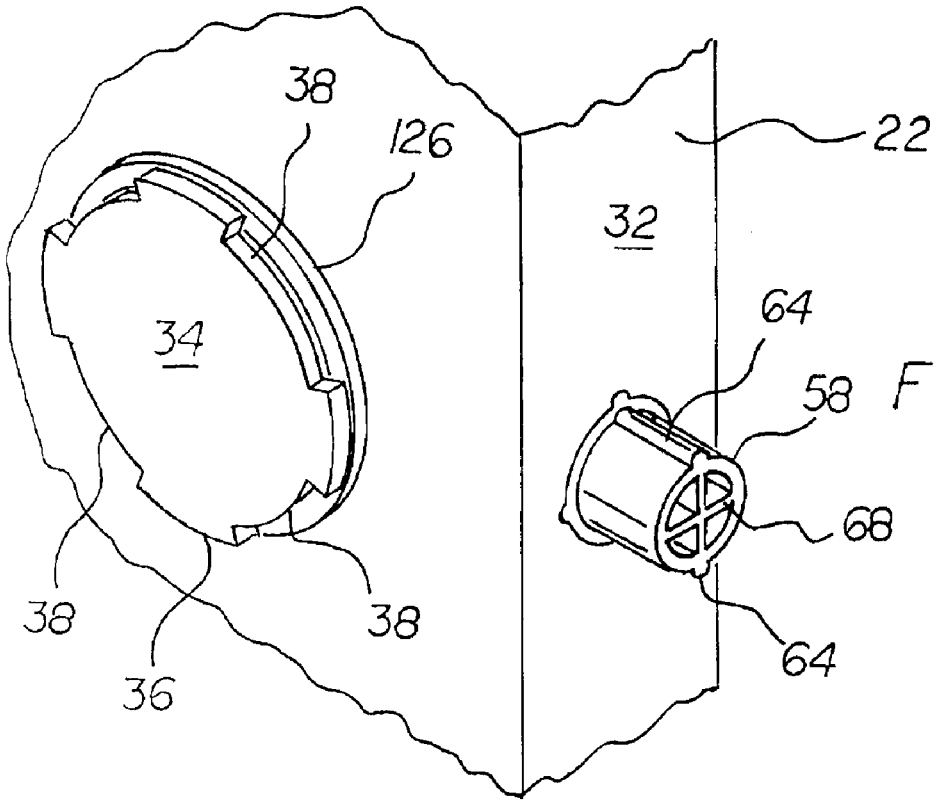
FIG. 14 is a detailed view of an alternative embodiment of the present invention wherein a bonus ring is included about the rosette.
Figure 15:
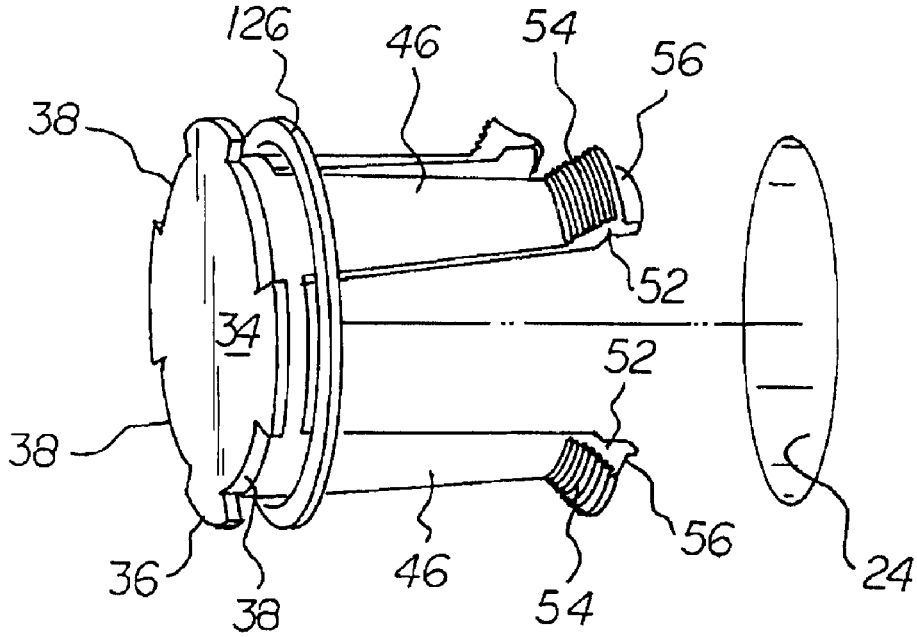
FIG. 15 is a exploded view of the embodiment of FIG. 14.

As noted in FIGS. 14 and 15, a bonus ring 126 can be included around the base plate 36 of rosette 34. This bonus ring 126 permits the assembly 20 of the present invention to be utilized in connection with larger lock openings 24. More specifically, bonus ring 126 acts like a washer in taking up any excess space between the periphery of base plate 36 and the lock opening 24.

Thus, with either embodiment, the inside plate 112 and rosette 34 are thus sized and positioned such that they can be painted over with the paint line falling within the dimensions of a final finished lockset escutcheon. This eliminates the need to mask the final lockset during subsequent painting.

The Extended and Retracted Orientations

Once assembled, lateral sliding movement of locking arm 84 within slot 82 moves bolt 58 from a retracted position (FIG. 5) to an extended position (FIG. 7) to engage the standard barrel aperture in the associated door jam. It is noted that once bolt 58 is fully extended, locking arm 84 is in a horizontal position such that detent 92 is positioned to engage against the upstanding post 122 of inside plate 112 thereby "locking" bolt 58 in its extended position. Conversely, to retract bolt 58 within barrel 62, locking arm 84 is rotated and slides within slot 82 until detent 92 is positioned to engage against the upstanding arcuate wall 124 of inside plate 112 thereby "locking" bolt 58 in the retracted position.

The present disclosure includes that contained in the appended claims, as well as that of the foregoing description. Although this invention has been described in its preferred form with a certain degree of particularity, it is understood that the present disclosure of the preferred form has been made only by way of example and that numerous changes in the details of construction and the combination and arrangement of parts may be resorted to without departing from the spirit and scope of the invention.

Now that the invention has been described,

What is claimed is:

1. A temporary door lock system for use during residential or commercial construction comprising:

a door having an interior side, an exterior side, and a longitudinal edge there between, a lock opening having a diameter and extending through the interior and exterior sides, a bore interconnected to the lock opening and extending through the longitudinal edge;

a rosette having a base plate with an interior side, and exterior side, a peripheral edge, a series of notches formed about the peripheral edge, a female semicircular boss, a pair of rails, and four biased locking arms formed upon the interior side of the base plate, each of the arms being inwardly tapered along a length and including an outwardly angled distal end, each distal end further including a series of teeth, the base plate having a diameter that is larger than the diameter of the lock opening, the base plate being positioned over the exterior side of the lock opening such that the locking arms of the rosette extend through the interior side of the lock opening;

a bolt having a proximal end, a distal end, and an intermediate extent there between, a pair of ribs extending along the intermediate extent of the bolt, an actuating hole formed through the proximal end;

a barrel having a hollow interior, a proximal end, a distal end, and an intermediate extent therebetween, a series of ribs positioned along the intermediate extent of the barrel, a pair of receiving grooves formed along a length of the hollow interior, a semi-circular notch end formed through the proximal end of the barrel, a slot interconnected to the semi-circular notch end and extending along a length of the intermediate extent, the bolt telescopically positioned within the barrel with the ribs of the bolt being positioned within the receiving grooves of the barrel and with the actuating hole of the bolt being accessible through the slot of the barrel, the bolt and barrel being positioned within the bore of the door and further being secured to the rosette by positioning the female semi-circular boss of the rosette within the semi-circular notch of the barrel with the intermediate extent of the barrel resting upon the pair of rails;

a locking arm having a first end with a turn knob and a second end with a pair of resilient tabs, a detent positioned intermediate the first and second ends of the locking arm, the resilient tabs being rotatably secured within the actuating hole of the bolt, whereby the detent can be rotated relative to the bolt and barrel via the turn knob;

an inside plate having an interior side, an exterior side, and a peripheral edge, a series of four slots formed through the inside plate, the slots each include a beveled edge adjacent the peripheral edge of the inside plate with a series of teeth formed thereon, a diametrical slot formed through the inside plate, the inside plate further including a male post and an arcuate wall formed upon the exterior side, the inside plate having an outside diameter that is larger than the diameter of the lock opening, the inside plate being positioned over the interior side of the lock opening such that the four distal ends of the locking arms are positioned within the four slots with the teeth of the distal ends lockingly engaging the teeth of the beveled edges, the inside plate is further positioned such that the male post of the inside plate extends through the semi-circular notch of the barrel and into the female semicircular boss of the rosette with the arcuate wall supporting the intermediate extent of the barrel;

whereby the bolt has both a first retracted orientation wherein the bolt is housed within the barrel and a second extended orientation wherein the bolt is extended from the distal end of the barrel, in the first retracted orientation the detent is locked against the arcuate wall such that the lock knob is maintained at the proximal end of the slot, in the second extended orientation the lock knob is rotated and moved to the distal end of the slot where the detent is locked against the post.

* * * * *